United States Patent [19]

White

[11] 3,997,023

[45] Dec. 14, 1976

[54] LOUDSPEAKER WITH IMPROVED SURROUND

[76] Inventor: Stanley F. White, P.O. Box 86, Roselle, Ill. 60172

[22] Filed: Dec. 10, 1975

[21] Appl. No.: 639,306

[52] U.S. Cl. ..... 181/171; 181/172
[51] Int. Cl.[2] ..... G10K 13/00; H04R 7/00
[58] Field of Search ..... 181/157, 167, 169–172

[56] References Cited

UNITED STATES PATENTS

| | | | |
|---|---|---|---|
| 1,582,473 | 4/1926 | Kay et al. | 181/170 |
| 2,030,501 | 2/1936 | Cunningham | 181/172 |
| 3,645,356 | 2/1972 | Sotome | 181/172 |
| 3,684,052 | 8/1972 | Sotome | 181/171 |
| 3,858,680 | 1/1975 | Tsuge et al. | 181/172 |
| 3,862,376 | 1/1975 | White | 181/167 |

*Primary Examiner*—Stephen J. Tomsky
*Attorney, Agent, or Firm*—Leydig, Voit, Osann, Mayer & Holt, Ltd.

[57] ABSTRACT

A loudspeaker comprises a frame, a cone assembly which includes a cone body having an outer periphery spaced away from the frame, and a flexible annular surround connecting the periphery of the cone body to the frame. The surround has an inner peripheral flange secured to the outer periphery of the cone body, an outer peripheral flange secured to the frame, and an arched web between the two flanges and spanning the gap between the cone body and the frame. The radial cross-section of the arched web has a varying radius of curvature with a greater radius at the bases thereof than at the apex. The preferred cross-sectional configuration is a parabola. The arched web decreases in thickness from the bases thereof toward the apex so that the minimum thickness is located at the apex of the arch and the maximum thickness is located at the bases of the arch. The surround is made of a solid resilient material having a durometer of less than about 55, preferably a rubber such as butyl. The surround is made by molding, and can be made in any desired color.

19 Claims, 5 Drawing Figures

LOUDSPEAKER WITH IMPROVED SURROUND

DESCRIPTION OF THE INVENTION

The present invention relates generally to loudspeakers, and, more particularly, to a loudspeaker having an improved surround.

It is a primary object of the present invention to provide a loudspeaker having an improved surround that reduces distortion in the audio output of the speaker, with corresponding improvements in the audio fidelity.

It is another object of the invention to provide a loudspeaker with an improved surround that provides a high degree of speaker sensitivity to its input signals.

A further object of the invention is to provide a loudspeaker having an improved surround that provides extremely low noise generation over a wide frequency range, including relatively low frequencies.

Still another object of the invention is to provide a loudspeaker with an improved surround that significantly reduces the "edge hole" effect, undesired peripheral waves, and undesired reflection of radial waves.

It is yet another object of the invention to provide a loudspeaker with an improved surround that provides a high degree of linearity in the response of the speaker to its input signals.

Other objects and advantages of the invention will be apparent from the following details description and the accompanying drawings, in which.

Figure 3:
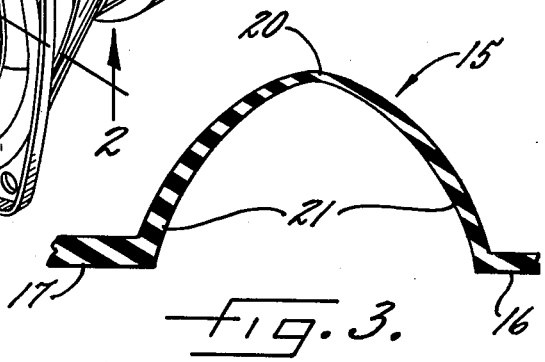
Figure 2:
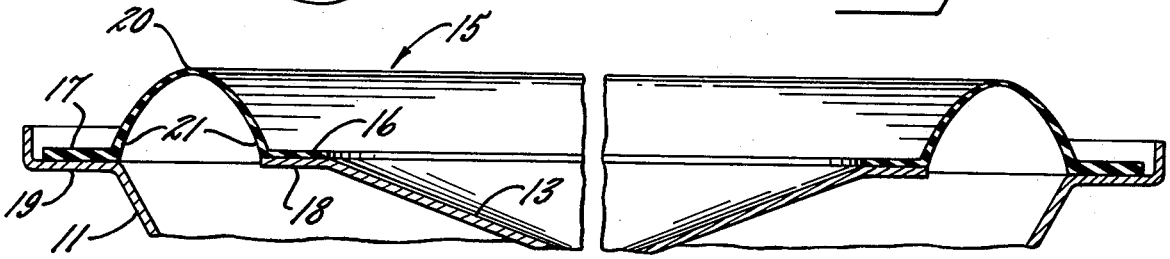
FIG. 2 is a section taken along line 2—2 in FIG. 1 with the speaker and the surround shown in their normal rest position.
Figure 2A:
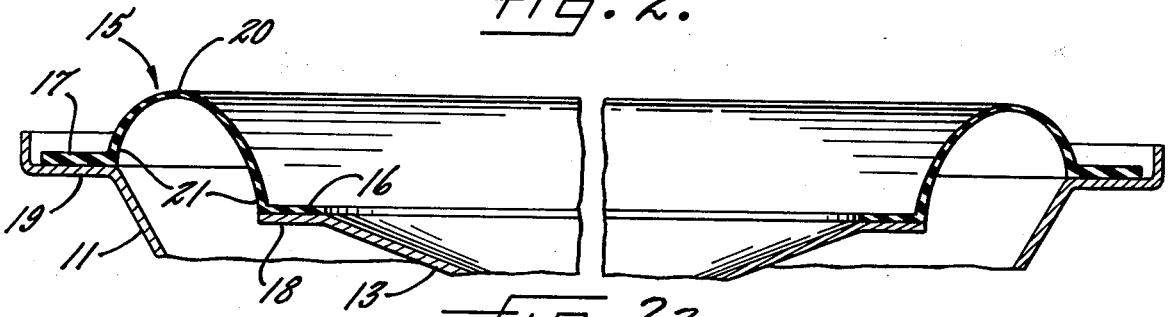
Figure 2B:
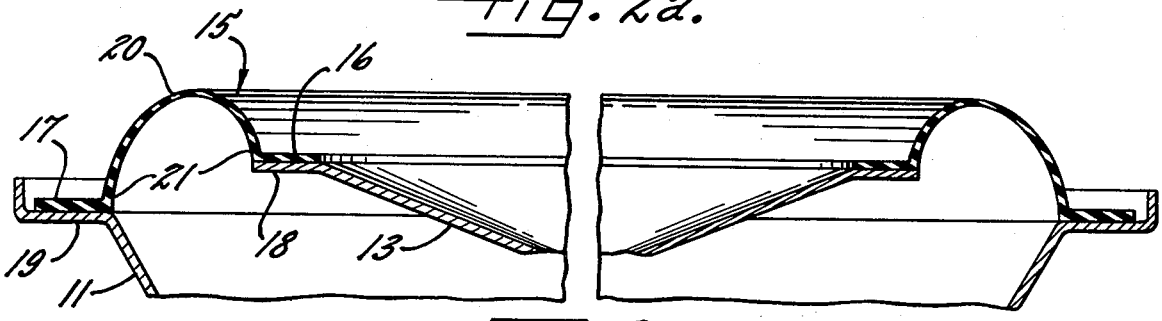

FIG. 2*a* is the same section shown in FIG. 2 with the speaker and the surround shown displaced inwardly from their normal rest position;

FIG. 2*b* is the same section shown in FIG. 2 with the speaker and the surround shown displaced outwardly from their normal rest position; and FIG. 3 is an enlarged sectional view of one side of the surround section shown in FIG. 2.

While the invention will be described in connection with a certain preferred embodiment, it will be understood that there is no intent to limit the invention to that particular embodiment. On the contrary, the intention is to cover all alternatives, modifications, and equivalents included within the spirit and scope of the invention as defined by the appended claims.

Figure 1:
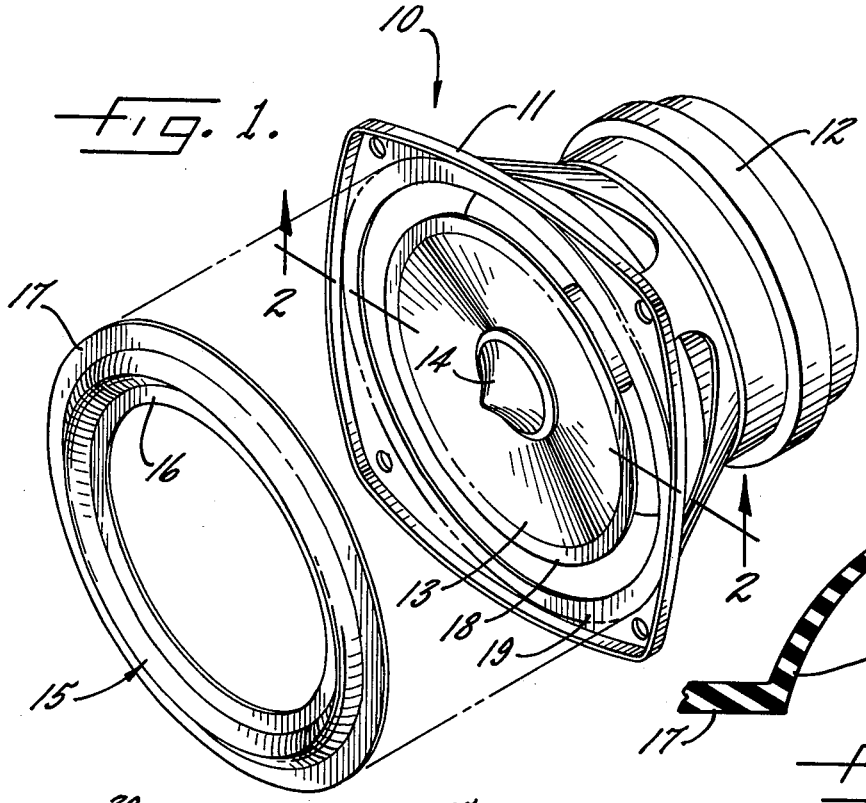
FIG. 1 is a perspective view of a loudspeaker embodying the invention, with the surround shown in an exploded position.

Turning now to the drawings, and referring first to FIG. 1, there is shown a loudspeaker 10 comprising a rigid frame 11 carrying a conventional magnetic assembly 12 which forms an internal air gap for receiving a voice coil. Although not visible in FIG. 1, the voice coil is typically wound on a cylindrical member which carries the speaker cone 13 so that the cone 13 is vibrated in the direction of its axis in response to the input signal applied to the voice coil. In the illustrative embodiment, a cap 14 encloses the central throat of the cone 13 and vibrates therewith. The throat of the cone is generally guided by an internal spider (not shown), while the outer periphery of the cone is guided by a flexible surround 15 which is secured to both the cone 13 and the frame 11 and spans the annular gap therebetween.

For securing the surround 15 to the frame 11 and the cone 13, annular flats 16 and 17 form flanges around the inner and outer peripheries, respectively, of the surround. The inner flat 16 is bonded, typically by means of an adhesive, to a complementary land 18 formed on the outer periphery of the cone 13. Similarly, the outer flat 17 is bonded to a land 19 formed by the frame 11. Between the two peripheral flats 16 and 17, the surround forms an arched annular web 20 which serves to interconnect the cone 13 and the frame 11 while permitting relative movement therebetween.

In accordance with one important aspect of the present invention, the radial cross-sectional of the arched web portion of the surround has a varying radius of curvature with a greater radius at the bases thereof than at the apex. Thus, as can be seen in FIGS. 2 and 3, the arched portion 20 of the surround 15 is in the shape of a parabola, which is the preferred cross-sectional configuration. This parabolic configuration provides the arched portion 20 of the surround with relatively steep side walls, as compared with a semi-circular arch for example. The parabolic shape also offers a high resistance to shear stresses and, consequently, is effective in suppressing or attenuating undesirable circumferential or peripheral waves, sometimes referred to as "Chinese gong" vibrations.

In further keeping with the invention, the arched web portion of the surround has a variable thickness, decreasing in thickness from the bases toward the apex so that the minimum thickness is located at the apex of the parabola and the maximum thickness is located at the apex of the parabola and the maximum thickness is located at the bases. Thus, as can be seen most clearly in FIG. 3, the thickness at both bases 21 and the arch 20 are substantially greater than the thickness at the apex of the arch. Preferably, the base thickness is at least twice the apex thickness. The thin apex tends to impede the transmission of energy through the surround in the radial direction so that any radial vibrations transmitted outwardly from the cone 13 are suppressed or attenuated before they reach the rigid frame 11. Similarly, any reflected waves traveling back toward the cone 13 from the rigid frame 11 tend to be suppressed or attentuated, so that the overall distortion or noise contributed to the audio output of the speaker by the surround and the frame is minimal. The reduced mass of the surround also improves the overall efficiency and sensitivity of the speaker assembly, while the thicker base portions of the arch 20 still provide the requisite lateral stability.

The combination of the parabolic arch and the variable thickness along the arch has been found to produce a unique dynamic effect which is a significant factor in the improved performance of the speaker. Thus, during vibratory movement of the speaker cone 13 in the direction of its axis, the parabolic portion of the surround tends to move with a smooth rolling action, as illustrated in the sequence of cross-sectional views in FIGS. 2, 2*a* and 2*b*. There appears to be very little stretching of the surround, so that there is little energy absorbed by the surround for later release in the form of noise and/or heat, both of which contribute to distortion in the audio output of a loudspeaker. The principal movement in the surround is confined to the inner half of the arch 20, so that the vibrating cone effectively terminates at the apex of the parabola. It has also been found that this surround significantly reduces the objectionable edge hole effect that is often encountered in loudspeakers.

As a further aspect of the invention, the variable radius or parabolic surround is made of a low durometer material, preferably a rubber such as butyl. In general, it is preferred to use a material having a durometer of less than about 55. It has been found that such a low durometer material provides the requisite stability for the speaker cone, and yet it absorbs relatively little energy under deformation, transmits sound at relatively low velocities, and has good damping characteristics. The low durometer material does not readily reflect vibrations, and in general is a "quiet" material, i.e., it contributes relatively little noise to the speaker output, particularly when used in the preferred parabolic configuration provided by the present invention. It should be understood that the preferred material is a solid material, as opposed to foamed or cellular materials such as urethane foams. If desired, the surround can be molded from rubbers or other materials of different colors in order to provide different aesthetic effects.

In general, is is preferred that surrounds incorporating the features of this invention be manufactured by injection molding, although the surrounds may be formed by compression molding or other molding techniques if desired. As will be understood by those familiar with the molding art, injection molding involves the introduction of molten material into a closed mold cavity under pressure, whereas in compression molding the starting material is placed in the mold cavity before the mold is closed. Injection molding is generally preferred because it produces a more uniform parabolic arch and permits shorter mold cycle times so that the surround can be produced at a minimum cost.

As can be seen from the foregoing detailed description, this invention provides an improved loudspeaker surround that reduces distortion in the audio output of the speaker, with corresponding improvements in the audio fidelity. The surround provides a high degree of speaker sensitivity to its input signals, while at the same time providing extremely low noise generation over a wide frequency range, including relatively low frequencies. The variable radius of parabolic surround with the variable thickness also significantly reduces the edge hole effect, undesired peripheral waves, and undesired reflection of radial waves. Furthermore, the improved surround provides a high degree of linearity in the response of the speaker to its input signals.

I claim as my invention:

1. A loudspeaker comprising the combination of a frame, a cone assembly which includes a cone body having an outer periphery spaced away from said frame, and a flexible annular surround connecting the periphery of the cone body to the frame, said surround having an inner peripheral flange secured to the outer periphery of the cone body, an outer peripheral flange secured to the frame, and an arched web between the two flanges and spanning the gap between the cone body and the frame, the radial cross-section of said arched web having a varying radius of curvature with a greater radius at the bases thereof than an the apex.

2. A loudspeaker as set forth in claim 1 wherein the radial cross-section of said arched web is in the shape of a parabola.

3. A loudspeaker as set forth in claim 1 wherein the surround is made of a solid resilient material having a durometer of less than about 55.

4. A loudspeaker as set forth in claim 1 wherein the arched web of the surround decreases in thickness from the bases thereof toward the apex so that the minimum thickness is located at the apex of the arch and the maximum thickness is located at the bases of the arch.

5. A loudspeaker as set forth in claim 4 wherein the surround is made of a resilient material having a durometer of less than about 55.

6. A loudspeaker as set forth in claim 5 wherein said resilient material is solid.

7. A loudspeaker comprising the combination of a frame, a cone assembly which includes a cone body having a outer periphery spaced away from said frame, and a flexible annular surround connecting the periphery of the cone body to the frame, said surround having an inner peripheral flange secured to the outer periphery of the cone body, an outer peripheral flange secured to the frame, and an arched web between the two flanges and spanning the gap between the cone body and the frame, said arched web decreasing in thickness from the bases thereof toward the apex so that the minimum thickness is located at the apex and the maximum thickness is located at the bases.

8. A loudspeaker as set forth in claim 7 wherein the surround is made of a resilient material having a durometer of less than about 55.

9. A loudspeaker as set forth in claim 8 wherein said resilient material is solid.

10. A loudspeaker surround having an inner peripheral flange for securing the surround to the outer periphery of a cone body, an outer peripheral flange for securing the surround to a rigid frame, and an arched web between the two flanges for spanning a gap between the cone body and the frame, the radial cross-section of said arched web having a varying radius of curvature with a greater radius at the bases thereof than at the apex.

11. A loudspeaker surround as set forth in claim 10 wherein the radial cross-section of said arched web is in the shape of a parabola.

12. A loudspeaker surround as set forth in claim 10 wherein the surround is made of a resilient material having a durometer of less than about 55.

13. A loudspeaker surround as set forth in claim 12 wherein said resilient material is solid.

14. A loudspeaker surround as set forth in claim 10 wherein the arched web of the surround decreases in thickness from the bases thereof toward the apex so that the minimum thickness is located at the apex of the arch and the maximum thickness is located at the bases of the arch.

15. A loudspeaker surround as set forth in claim 14 wherein the surround is made of a resilient material having a durometer of less than about 55.

16. A loudspeaker surround as set forth in claim 15 wherein said resilient material is solid.

17. A loudspeaker surround comprising a flexible annulus having an inner peripheral flange for securing the surround to the outer periphery of a cone body, an outer peripheral flange for securing the surround to a rigid frame, and an arched web between the two flanges for spanning a gap between the cone body and the frame, the thickness of the arched web decreasing from the bases thereof toward the apex so that the minimum thickness is located at the apex and the maximum thickness is located at the bases.

18. A loudspeaker surround as set forth in claim 17 wherein the surround is made of a resilient material having a durometer of less than about 55.

19. A loudspeaker surround as set forth in claim 18 wherein said resilient material is solid.

* * * * *